US012571078B2

(12) United States Patent
Fan et al.

(10) Patent No.: US 12,571,078 B2
(45) Date of Patent: Mar. 10, 2026

(54) DIE-CASTING ALUMINUM ALLOY MATERIAL PRODUCED ENTIRELY FROM RECYCLED MATERIAL AND PREPARATION METHOD THEREOF

(71) Applicants: Huajin New Materials Research Institute (Guangzhou) Co., Ltd., Guangzhou (CN); Guangdong Hongbang Aluminum Metal Industry Co., Ltd., Guangzhou (CN)

(72) Inventors: Weizhong Fan, Guangzhou (CN); Weiquan Gao, Guangzhou (CN); Jun Yan, Guangzhou (CN); Zhenjiang Yang, Lufeng (CN); Minding Chen, Gaoyao (CN); Jiacheng Huang, Foshan (CN); Jingnan He, Guangzhou (CN); Zhifu Liang, Luoding (CN)

(73) Assignees: Huajin New Materials Research Institute (Guangzhou) Co., Ltd., Guangzhou City (CN); Guangdong Hongbang Aluminum Metal Industry Co., Ltd., Guangzhou City (CN)

( * ) Notice: Subject to any disclaimer, the term of this patent is extended or adjusted under 35 U.S.C. 154(b) by 372 days.

(21) Appl. No.: 18/275,107

(22) PCT Filed: Aug. 3, 2022

(86) PCT No.: PCT/CN2022/109890
§ 371 (c)(1),
(2) Date: Jul. 31, 2023

(87) PCT Pub. No.: WO2024/026711
PCT Pub. Date: Feb. 8, 2024

(65) Prior Publication Data

US 2024/0240289 A1 Jul. 18, 2024

(51) Int. Cl.

| | |
|---|---|
| ***C22C 21/02*** | (2006.01) |
| ***C22B 21/00*** | (2006.01) |
| ***C22C 1/02*** | (2006.01) |

(52) U.S. Cl.
CPC ..... *C22C 21/02* (2013.01); *C22B 21/0092* (2013.01); *C22C 1/026* (2013.01)

(58) Field of Classification Search
CPC ..... C22C 21/02; C22C 1/026; C22B 21/0092; C22F 1/043
See application file for complete search history.

(56) References Cited

FOREIGN PATENT DOCUMENTS

| | | | |
|---|---|---|---|
| CN | 107829000 | A | 3/2018 |
| CN | 113005340 | A | 6/2021 |
| CN | 114807689 | A | 7/2022 |
| PL | 176622 | B1 | 7/1999 |
| WO | 2016/161908 | A1 | 10/2016 |

OTHER PUBLICATIONS

International Search Report dated Jan. 6, 2023, from the ISA/CN, for International Patent Application No. PCT/ CN2022/109890 (filed Aug. 3, 2022), 4 pgs.

*Primary Examiner* — Jessee R Roe
(74) *Attorney, Agent, or Firm* — Ascenda Law Group, PC

(57) ABSTRACT

The disclosure pertains to a high-performance, low-cost aluminum alloy material produced entirely from recycled materials and its preparation method. The alloy comprises the following components by weight percentage: Si: 10%-11%; Mg: 0.50%-0.65%; Mn: 0.01%-0.20%; Cu: 1.0%-1.2%; 0<Ni≤0.5%; Fe: 0.7%-0.9%; 0<Ti≤0.20%; Zn: 2.0%-2.5%; 0<Pb≤0.1%; 0<Sn≤0.1%; the total of the remaining impurities being controlled at less than 1%, with the balance being Al. Compared with a conventional ADC12 alloy, the raw materials are more widely available and the cost is lower, but the mechanical performance, thermal conductivity and weather resistance are all superior to the ADC12 alloy. The alloy die-casting test bar of the present disclosure has a tensile strength ≥270 Mpa, a yield strength ≥150 MPa, an elongation ≥2.5%, and a thermal conductivity ≥110W/m·k. The material is a green material that complies with circular economy.

8 Claims, 3 Drawing Sheets

| Name of recycled material | Content of element (%) | | | | | | | | | | | Note |
|---|---|---|---|---|---|---|---|---|---|---|---|---|
| | Silicon | Copper | Manganese | Magnesium | Iron | Zinc | Nickel | Tin | Lead | Titanium | Aluminum | |
| High silicon aluminum casting | 16-18 | 4.0-5.0 | ≤0.5 | 0.45-0.65 | ≤1.3 | ≤1.5 | ≤0.3 | ≤0.3 | ≤0.2 | ≤0.3 | balanced | ADC14 |
| High magnesium trimmings | ≤0.40 | ≤0.1 | 0.4-1.0 | 4.0-4.9 | ≤0.40 | ≤0.25 | | | | ≤0.15 | balanced | 5083 |
| Die-casting zinc furnace slag | ≤0.1 | | | 0.03-0.06 | ≤0.1 | balanced | | | | | 3.9-4.3 | Zinc Alloy 3 |
| Copper communication wire nodules | | ≥99 | | | | | | | | | | |
| Copper-clad aluminum wire | ≤0.2 | ≥25 | | | | | | | | | balanced | Thick wire |
| Copper-clad aluminum wire | ≤0.2 | ≥42 | | | | | | | | | balanced | Thin wire |
| Waste aluminum wire | ≤0.2 | | | | ≤0.3 | | | | | | balanced | |
| Raw aluminum scrap | 7.5-9.5 | 2.0-4.0 | ≤0.5 | ≤0.3 | ≤1.3 | ≤1.0 | ≤0.5 | ≤0.2 | ≤0.2 | ≤0.3 | balanced | ADC10 |
| Raw aluminum scrap | 9.6-12.0 | 1.5-3.5 | ≤0.5 | ≤0.3 | ≤1.3 | ≤1.0 | ≤0.5 | ≤0.2 | ≤0.2 | ≤0.3 | balanced | ADC12 |
| Raw aluminum scrap | 7.5-9.5 | 3.0-4.0 | ≤0.5 | ≤0.1 | ≤1.3 | ≤3.0 | ≤0.5 | ≤0.35 | ≤0.1 | | balanced | A380 |
| Wrought aluminum scrap | 0.4-0.8 | 0.15-0.40 | ≤0.15 | 0.80-1.20 | ≤0.7 | ≤0.25 | | | | ≤0.15 | balanced | 6061 |
| Wrought aluminum scrap | 0.2-0.6 | ≤0.10 | ≤0.10 | 0.45-0.90 | ≤0.35 | ≤0.10 | | | | ≤0.10 | balanced | 6063 |
| Magnesium alloy scrap | | | 0.17-0.40 | balanced | | 0.45-0.90 | | | | | 8.5-9.5 | AZ91D |
| High silicon remelted ingot | 16-18 | 4-5 | ≤0.1 | 0.50-0.65 | ≤0.4 | ≤0.10 | | | | ≤0.20 | balanced | A390 |
| Aluminum-zinc-silicon high-strength aluminum | 7.5-9.5 | 1.5-3.5 | ≤0.8 | ≤0.3 | ≤0.5 | 10-21 | ≤0.5 | ≤0.05 | ≤0.10 | ≤0.10 | balanced | high-strength aluminum |
| Aluminum-magnesium-silicon high-toughness aluminum | 1.8-2.6 | | 0.5-0.8 | 5-6 | ≤0.2 | | | ≤0.05 | ≤0.10 | ≤0.20 | | magsimal 59 |

Figure 1

DIE-CASTING ALUMINUM ALLOY MATERIAL PRODUCED ENTIRELY FROM RECYCLED MATERIAL AND PREPARATION METHOD THEREOF

TECHNICAL FIELD

The disclosure pertains to an aluminum alloy material, especially to a low-cost, high-performance aluminum alloy material produced entirely from recycled materials and its preparation method.

BACKGROUND ART

With the development of 5G technology, the emergence of smart homes has aroused people's interest, and smart appliances are becoming more and more common, which poses higher requirements on the performance of alloy materials.

SUMMARY

Technical Problem

Among the conventional die-casting aluminum alloy materials, the most used aluminum alloy is the aluminum alloy with the grade ADC12. If higher mechanical properties are required, A380 alloy can be used instead. However, the thermal conductivity of these two grades of materials is only 96 W/m·k. Meanwhile, these two grades of materials have high copper content, high cost and poor weather resistance.

Therefore, a material with higher thermal conductivity than the ADC12 alloy, but with lower cost than the ADC12 alloy and comparable or higher mechanical properties than the ADC12 alloy, is needed.

Solution to Problem

Technical Solution

The purpose of the present disclosure is to provide a high-performance, low-cost die-casting aluminum alloy material produced entirely from recycled materials and its preparation method, which has excellent mechanical properties, high thermal conductivity and high weather resistance.

The die-casting aluminum alloy material of the present disclosure produced entirely from recycled material comprises the following components by weight percentage: Si: 10%-11%; Mg: 0.50%-0.65%; Mn: 0.01%-0.20%; Cu: 1.0%-1.2%; 0<Ni≤0.5%; Fe: 0.7%-0.9%; 0<Ti≤0.20%; Zn: 2.0%-2.5%; 0<Pb≤0.1%; 0<Sn≤0.1%; the total of the remaining impurities being controlled at less than 1%, with the balance being Al.

Further, the metal elements included in the alloy are derived from recycled materials.

Further, the recycled materials mainly include but not limited to the following materials: raw aluminium scrap; wrought aluminum scrap; die-casting zinc furnace slag (zinc content ≥95%); waste copper wire (Cu≥99%) or copper-clad aluminum wire (Cu: 25%-42%); high silicon aluminum for piston or hypereutectic aluminum alloy castings (such as ADC14 or A390 alloy); magnesium alloy scrap (magnesium content ≥90%); high-silicon remelted ingot (also called recycled ingot); die-casting high-strength aluminum scrap (aluminum-zinc-silicon series) used in mobile phone mid-plate; or waste aluminum-magnesium-silicon series high-toughness aluminum alloy die-casting material (similar to magsimal 59 from Rheinmetall in Germany); die-casting material used in mobile phone mid-plate.

Further, the aluminum alloy material has Zn/Cu≥2 by weight percentage.

Further, the aluminum alloy material has Cu/Mn≥6 by weight percentage.

Further, the aluminum alloy material has a tensile strength ≥270 MPa, a yield strength ≥150 MPa, an elongation ≥2.5% and a thermal conductivity ≥110 W/m·k. The grade of the die-casting aluminum alloy material prepared by the present disclosure is HY-A01R.

The method for preparing a die-casting aluminum alloy material of the present disclosure comprises the steps of:

(1) feeding a remelted ingot into a furnace, heating to 750-800° C., melting and forming furnace water.

(2) adding the following recycled materials in sequence: high silicon castings, aluminum-zinc-silicon series castings, high magnesium trimmings, raw aluminum scrap and wrought aluminum scrap.

(3) melting the recycled materials, wherein the melted recycled material includes the following components by weight percentage: Si: 10%-11%; Mg: 0.50%-0.65%; Mn: 0.01%-0.20%; Cu: 1.0%-1.2%; 0<Ni≤0.5%; Fe: 0.7%-0.9%; 0<Ti≤0.20%; Zn: 2.0%-2.5%; 0<Pb≤0.1%; 0<Sn≤0.1%; the total of the remaining impurities being controlled at less than 1%, with the balance being Al.

(4) Refining, degassing, filtering and casting an ingot.

Further, the preparation method also comprises feeding the following recycled materials in step (2): die-casting zinc furnace slag; waste copper wire or copper-clad aluminum wire; high silicon aluminum for piston or hypereutectic aluminum alloy casting; magnesium alloy scrap; high-silicon remelted ingot; aluminum-zinc-silicon series high-strength aluminum; or aluminum-magnesium-silicon series high toughness aluminum alloy.

The present disclosure overcomes the deficiencies of the prior art and provides a die-casting aluminum alloy material produced entirely from recycled materials and a preparation method thereof. In order to enable the alloy material to have better casting performance, Si is preferably at 10%-11%. In order to ensure the strength of the alloy material, Mg is preferably 0.50%-0.65% and Zn/Cu≥2, so that Mg and Si can produce $Mg_2Si$, and at the same time, there is enough Mg and Zn to combine to form $Mg_2Zn$. In order to ensure the thermal conductivity of the alloy material, the alloy material is preferably Cu/Mn≥6 to limit the addition of manganese. In order to balance the weather resistance and mechanical properties of the alloy material, Cu is preferably 1.0%-1.2%.

Beneficial Effect of Disclosure

Beneficial Effect

Compared with the deficiencies and shortcomings of the prior art, the present disclosure has the following beneficial effects:

(1) The die-casting aluminum alloy material of the present disclosure has excellent mechanical properties and high thermal conductivity, as shown by the test bar test, which has a tensile strength ≥270 MPa, a yield strength ≥150 MPa, an elongation ≥2.5% and a thermal conductivity ≥110 W/m·k. Meanwhile, the die-casting aluminum alloy material of the present disclosure has excellent weather resistance.

(2) The raw materials of the die-casting aluminum alloy of the present invention are all from recycled materials, and the metal elements in the components are added to the furnace in the form of recycled materials, and alloying is formed by melting, which not only reduces the manufacturing cost, but also conforms to the principle of green economy.

BRIEF DESCRIPTION OF DRAWINGS

Description of Drawings

FIG. 1 shows the composition of recycled materials.

Figure 2:
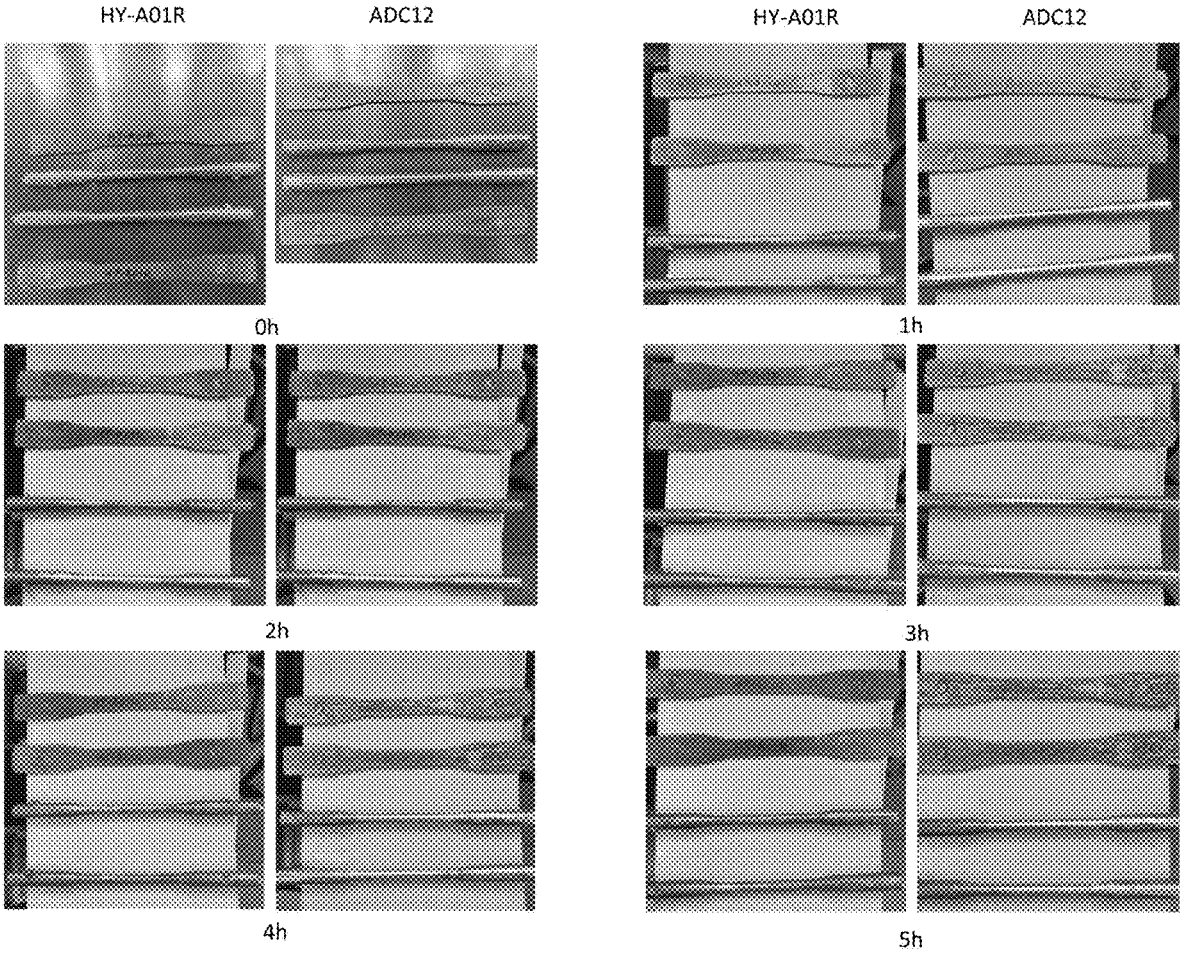

FIG. 2 shows the appearance changes of an HY-A01R alloy and an ADC12 alloy die-castings in the neutral salt spray test for 0-5 h.

Figure 3:
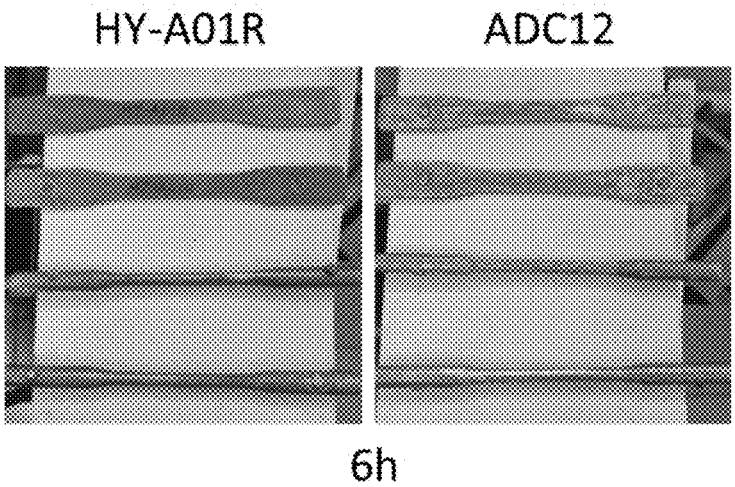

FIG. 3 shows the appearance comparison between an HY-A01R alloy and an ADC12 alloy die-castings in the neutral salt spray test after 6 hours.

EMBODIMENTS OF DISCLOSURE

Detailed Description of Embodiments

The present disclosure will be described in further detail below in conjunction with the accompanying drawings. It should be understood that the described embodiments are illustrative only and are not intended to limit the scope of the claims of the present disclosure.

Example 1

The die-casting aluminum alloy material of the present disclosure was prepared through the following steps:

S1 The purchased recycled materials were sampled according to the sampling rules and tested to ensure that all recycled materials have basic components.

S2 The ingredients were calculated and compounded according to the ingredient list.

S3 The remelted ingot (also known as recycled ingot) tested in S1 was fed into a furnace, heated to 750-800° C., and melted to form furnace water.

S4 The following recycled materials were fed in sequence according to the ingredient list: high-silicon castings (grade ADC14 or A390 materials), aluminum-zinc-silicon series castings, high-magnesium trimmings (or materials similar to magsimal 59 from Rheinmetall in Germany), raw aluminum scrap and wrought aluminum scrap.

S5 All the ingredients were melted, stirred and sampled for testing. When the molten material tested included the following components by weight percentage, it was deemed to meet the qualified standard: Si: 10%-11%; Mg: 0.50%-0.65%; Mn: 0.01%-0.20%; Cu: 1.0%-1.2%; $0<Ni\leq0.5\%$; Fe: 0.7%-0.9%; $0<Ti\leq0.20\%$; Zn: 2.0%-2.5%; $0<Pb\leq0.1\%$; $0<Sn\leq0.1\%$; the total of the remaining impurities being controlled at less than 1%, with the balance being Al.

S6 If the molten material tested in S5 failed:

a. If silicon was insufficient, high silicon piston castings (for example, AC9A material from Japan, the silicon content of which is about 22%) would be added.

b. If copper was insufficient, waste copper wire (copper ≥99%) or copper-clad aluminum wire (copper 25% (thick wire)–42% (thin wire)) would be added.

c. If magnesium was insufficient, magnesium alloy die-castings (magnesium ≥90%) would be added.

d. If zinc was insufficient, die-casting zinc alloy furnace slag (zinc ≥95%) would be added.

e. If iron was insufficient, K aluminum from the electrolytic aluminum plant (unqualified product because of too much iron) or raw aluminum scrap would be added.

f. If a certain element in the molten material was excessive, waste aluminum wire or wrought aluminum scrap would be added to reduce the content of the excessive element; if magnesium was excessive, magnesium remover would be added.

S7 After the matter inspection was passed, refining, degassing, filtering, and casting an ingot was performed.

The grade of the die-casting aluminum alloy material prepared by the present disclosure is HY-A01R.

FIG. 1 shows the composition of recycled materials.

Examples 2-4

The die-casting aluminum alloy materials of Examples 2-4 were prepared in the same steps as in Example 1, except that the type and quality of the recycled materials added were different. Among them, the components contained in the molten material tested in S5 in Examples 1~4 were shown in Table 1 below.

TABLE 1

The main alloying composition of Examples 1-4 of the present invention and an ADC12 alloy and an A380 alloy

| | Example 1 | Example 2 | Example 3 | Example 4 | ADC12 alloy |
|---|---|---|---|---|---|
| Si (% w/w) | 10 | 11 | 10.5 | 10.5 | 10.8 |
| Mg (% w/w) | 0.5 | 0.65 | 0.58 | 0.6 | 0.26 |
| Mn (% w/w) | 0.01 | 0.2 | 0.15 | 0.2 | 0.17 |
| Cu (% w/w) | 1.0 | 1.2 | 1.1 | 1.2 | 1.7 |
| Ni (% w/w) | 0.01 | 0.1 | 0.2 | 0.5 | 0.12 |
| Fe (% w/w) | 0.7 | 0.9 | 0.8 | 0.9 | 0.81 |
| Ti (% w/w) | 0.01 | 0.2 | 0.1 | 0.2 | 0.01 |
| Zn (% w/w) | 2.0 | 2.5 | 2.25 | 2.5 | 0.93 |
| Pb (% w/w) | 0.01 | 0.1 | 0.05 | 0.1 | 0.07 |
| Sn (% w/w) | 0.01 | 0.1 | 0.05 | 0.1 | 0.02 |
| Al (% w/w) | balanced | balanced | balanced | balanced | balanced |

Effect Examples

The ingots prepared in the above Examples were melted in a machine-edge furnace, and then die-casted into test bars using a die-casting machine. A neutral salt spray test, mechanical performance test and thermal conductivity test were carried out on the HY-A01R alloys prepared according to Examples 1-4 of the present disclosure.

Neutral Salt Spray Test

The HY-A01R alloys of Examples 1-4 above and the ADC12 alloy (whose compositions were shown in Table 1) were made into two shapes (round and flat) of bar die-castings and subjected to 5% sodium chloride for neutral salt spray test according to GB10125-1997 test standard for a total of 6 hours, and their surface appearances were observed every hour to test their weather resistance. Among them, the result for Example 3 was shown in FIG. 2 and FIG. 3. In FIGS. 2-3, the first column was the HY-A01R alloy, and the second column was the ADC12 alloy. Referring to FIG. 2, at the beginning of the test (0 h), the surfaces of the round bar and flat bar of the HY-A01R alloy and the ADC12 alloy were smooth. Over time, corrosives began to appear on the surface of the ADC12 alloy. Referring to FIG. 3, at the 6th hour of the test, there was significant corrosion on the surface of the ADC12 alloy and only slight corrosion on the surface of the HY-A01R alloy. In the neutral salt spray test on all examples, the corrosion of the HY-A01R alloys obtained according to the present disclosure was obviously less significant than that of the conventional ADC12 alloy. Since the copper content in the HY-A01R alloy of the invention was lower than that of the ADC12 alloy, the weather resistance of the alloy obtained by present disclosure was obviously superior to that of the conventional ADC12 alloy.

At the same time, because the copper content of the conventional A380 alloy was higher than that of the ADC12 alloy, the weather resistance of the HY-A01R alloy of present disclosure was also superior to that of the A380 alloy.

Mechanical Performance Test

The HY-A01R alloys of the above Examples 1-4 were made into 6.4 mm die-castings, and their tensile strength, elongation and yield strength were tested according to the GB/T228.1-2010 test standard. 5 points of each sample were tested and an average value was taken. Among them, the result for Example 3 was shown in Table 2.

TABLE 2

Mechanical performance test results of the HY-A01R alloy die-castings

| | 6.4 mm die-casting tensile strength | | 6.4 mm die-casting elongation | | 6.4 mm die-casting yield strength | |
|---|---|---|---|---|---|---|
| Test point | Test value | Average value (MPa) | Test value | Average value (%) | Test value | Average value (MPa) |
| 1 | 326 | 320.4 | 3.06 | 2.848 | 156 | 161.8 |
| 2 | 329 | | 2.98 | | 164 | |
| 3 | 313 | | 2.72 | | 162 | |
| 4 | 322 | | 2.84 | | 165 | |
| 5 | 312 | | 2.64 | | 162 | |

It can be seen from Table 2 that the average tensile strength of the HY-A01R alloy die-casting obtained in Example 3 was 320.4 MPa, the elongation was 2.848%, and the yield strength was 161.8 MPa. The HY-A01R alloys prepared in the remaining examples all have a tensile strength ≥270 Mpa, a yield strength ≥150 MPa, and an elongation ≥2.5%. In contrast, the tensile strength of the conventional ADC12 alloy die-casting test bar was 228±41 MPa, the elongation was 1.4±0.8%, and the yield strength was 150±14 MPa. The mechanical performance of the HY-A01R alloy of present disclosure were obviously superior to the conventional ADC12 alloy.

Thermal Conductivity Measurement

The thermal conductivity test of the HY-A01R alloy die-castings produced in the above examples were carried out in the LFA 467 thermal conductivity instrument of NETZSCH. Among them, the result for Example 3 was shown in Table 3.

TABLE 3

Thermal conductivity test result of the HY-A01R alloy die-casting

| Test point | Thickness (mm) | Diameter (mm) | Density ($g/cm^3$) | Specific heat capacity at constant pressure (J/(g*K)) | Thermal diffusivity ($mm^2/s$) | Thermal conductivity W/(m*k) | Average value of thermal conductivity W/(m*k) |
|---|---|---|---|---|---|---|---|
| B1 | 2.03 | 12.65 | 2.700 | 0.882 | 57.002 | 135.795 | 137.449 |
| B2 | 2.03 | 12.65 | 2.700 | 0.882 | 57.151 | 136.143 | |
| B3 | 2.03 | 12.65 | 2.700 | 0.882 | 58.703 | 139.833 | |
| B4 | 2.03 | 12.65 | 2.700 | 0.882 | 57.946 | 138.025 | |

Referring to Table 3, the thermal conductivity, i.e. the average value of thermal conductivity, of the aluminum alloy die-casting obtained in Example 3 of the present disclosure was 137.449 W/(m*k). The thermal conductivities of the HY-A01R alloys prepared in the remaining examples were all greater than or equal to 110 W/m·k. The thermal conductivity of the conventional ADC12 alloy was only 96 W/(m*k). Therefore, the thermal conductivity of the HY-A01R alloy of the present disclosure was more excellent, and it was more suitable for use in components requiring rapid heat dissipation.

At the same time, it is reported in the literature that the thermal conductivity of the A380 alloy was only 96.2 W/(m*k), and the thermal conductivity of the HY-A01R alloy of the present disclosure was also better than that of the A380 alloy. This is because the addition of copper to the aluminum alloy results in a decrease in the thermal conductivity of the alloy.

Therefore, the mechanical performance of the die-casting aluminum alloys prepared by the present disclosure was superior to the conventional ADC12 alloy, and the thermal conductivity and weather resistance were superior to the conventional ADC12 alloy and the A380 alloy, which leads to wider applications. The bar test showed that the tensile strength of the alloy of the present disclosure was ≥270 MPa, the yield strength was ≥150 MPa, the elongation was ≥2.5%, and the thermal conductivity was ≥110 W/m·k.

The die-casting aluminum alloy prepared by the present disclosure is entirely produced from recycled materials which are melted to form an alloy, and the sources of the raw materials are wider, the production cost is lower, and it is a green material of circular economy.

The above is only preferred embodiments of the present invention, and is not intended to limit the invention. Any modifications, equivalent replacements and improvements made within the spirit and principles of the present invention shall be included in the scope of protection of the present invention.

What is claimed is:

1. A die-casting aluminum alloy material produced entirely from recycled materials, wherein the aluminum alloy comprises the following components by weight percentage: Si: 10%-11%; Mg: 0.50%-0.65%; Mn: 0.01%-0.20%; Cu: 1.0%-1.2%; 0<Ni≤0.5%; Fe: 0.7%-0.9%; 0<Ti≤0.20%; Zn: 2.0%-2.5%; 0<Pb≤0.1%; 0<Sn≤0.1%; the total of the remaining impurities being controlled at less than 1%, with the balance being Al.

2. The die-casting aluminum alloy material produced entirely from recycled materials of claim 1, wherein the metal elements in the aluminum alloy are derived from recycled materials.

3. The die-casting aluminum alloy material produced entirely from recycled materials of claim 2, wherein the recycled materials comprise one or more of the following materials: raw aluminium scrap; wrought aluminum scrap; die-casting zinc furnace slag; waste copper wire or copper-clad aluminum wire; high silicon aluminum for piston or hypereutectic aluminum alloy castings with a silicon content of 16-18%; magnesium alloy scrap; high-silicon remelted ingot with a silicon content of 16-18%.

4. The die-casting aluminum alloy material produced entirely from recycled materials of claim 1, wherein said aluminum alloy material has Zn/Cu≥2 by weight percentage.

5. The die-casting aluminum alloy material produced entirely from recycled materials of claim 1, wherein said aluminum alloy material has Cu/Mn≥6 by weight percentage.

6. The die-casting aluminum alloy material produced entirely from recycled material of claim 1, wherein said aluminum alloy material has a tensile strength ≥270 MPa, a yield strength ≥150 MPa, an elongation ≥2.5% and a thermal conductivity ≥110 W/m·k.

7. A method for preparing a die-casting aluminum alloy material of claim 1, comprising the steps of:

(1) feeding a remelted ingot into a furnace, heating to 750-800° C., melting and forming furnace water;

(2) adding the following recycled materials in sequence: high silicon castings with a silicon content of 16-18%, aluminum-zinc-silicon series castings, high magnesium trimmings with a magnesium content of 4.0-4.9%, raw aluminium scrap and wrought aluminum scrap;

(3) melting the recycled materials, wherein the melted recycled material comprises the following components by weight percentage: Si: 10%-11%; Mg: 0.50%-0.65%; Mn: 0.01%-0.20%; Cu: 1.0%-1.2%; 0<Ni≤0.5%; Fe: 0.7%-0.9%; 0<Ti≤0.20%; Zn: 2.0%-2.5%; 0<Pb≤0.1%; 0<Sn≤0.1%; the total of the remaining impurities being controlled at less than 1%, with the balance being Al;

(4) Refining, degassing, filtering and casting an ingot.

8. The method of claim 7, wherein the method further comprises feeding the following recycled materials in step (2): die-casting zinc furnace slag; waste copper wire or copper-clad aluminum wire; high silicon aluminum for piston or hypereutectic aluminum alloy castings with a silicon content of 16-18%; magnesium alloy scrap; high-silicon remelted ingot with a silicon content of 16-18%.

* * * * *